US010768542B2

(12) United States Patent
Mori

(10) Patent No.: US 10,768,542 B2
(45) Date of Patent: Sep. 8, 2020

(54) POSITIVELY CHARGEABLE TONER

(71) Applicant: KYOCERA Document Solutions Inc., Osaka (JP)

(72) Inventor: Takamichi Mori, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/410,722

(22) Filed: May 13, 2019

(65) Prior Publication Data

US 2019/0354031 A1 Nov. 21, 2019

(30) Foreign Application Priority Data

May 15, 2018 (JP) ..... 2018-093829

(51) Int. Cl.
*G03G 9/097* (2006.01)
*G03G 9/087* (2006.01)
*G03G 9/08* (2006.01)

(52) U.S. Cl.
CPC ..... *G03G 9/09716* (2013.01); *G03G 9/0819* (2013.01); *G03G 9/08711* (2013.01); *G03G 9/09725* (2013.01); *G03G 9/09733* (2013.01)

(58) Field of Classification Search
CPC ..... G03G 9/09725; G03G 9/09716; G03G 9/09708; G03G 9/09733; G03G 9/0819
See application file for complete search history.

(56) References Cited

U.S. PATENT DOCUMENTS 5,445,910 A * 8/1995 Ishikawa ..... G03G 9/08728 430/108.11
5,948,583 A * 9/1999 Silence ..... G03G 9/08782 430/108.8
6,190,815 B1 * 2/2001 Ciccarelli ..... G03G 9/09716 430/108.5
2006/0269858 A1 * 11/2006 McDougall ..... G03G 9/0806 430/106.1
2013/0115548 A1 * 5/2013 Yang ..... G03G 9/0806 430/105
2017/0248860 A1 * 8/2017 Nishitera ..... G03G 9/0819
2018/0024454 A1 * 1/2018 Ojima ..... G03G 9/0825 430/108.1
2019/0086826 A1 * 3/2019 Komada ..... G03G 9/09733

FOREIGN PATENT DOCUMENTS

JP H11-231571 A 8/1999

* cited by examiner

*Primary Examiner* — Christopher D Rodee
(74) *Attorney, Agent, or Firm* — Studebaker & Brackett PC

(57) ABSTRACT

A positively chargeable toner includes toner particles. The toner particles each include a toner mother particle containing a binder resin, and an external additive adhering to a surface of the toner mother particle. The external additive includes specific silica particles, specific titania particles, and specific crosslinked resin particles. The specific silica particles each include a silica base, and a first surface treatment layer present on a surface of the silica base. The first surface treatment layer has an alkyl group having a carbon number of at least 8 and no greater than 16, and an amino group. The specific titania particles each include a titania base, and a second surface treatment layer present on a surface of the titania base. The second surface treatment layer has an alkyl group having a carbon number of at least 3 and no greater than 8.

5 Claims, 1 Drawing Sheet

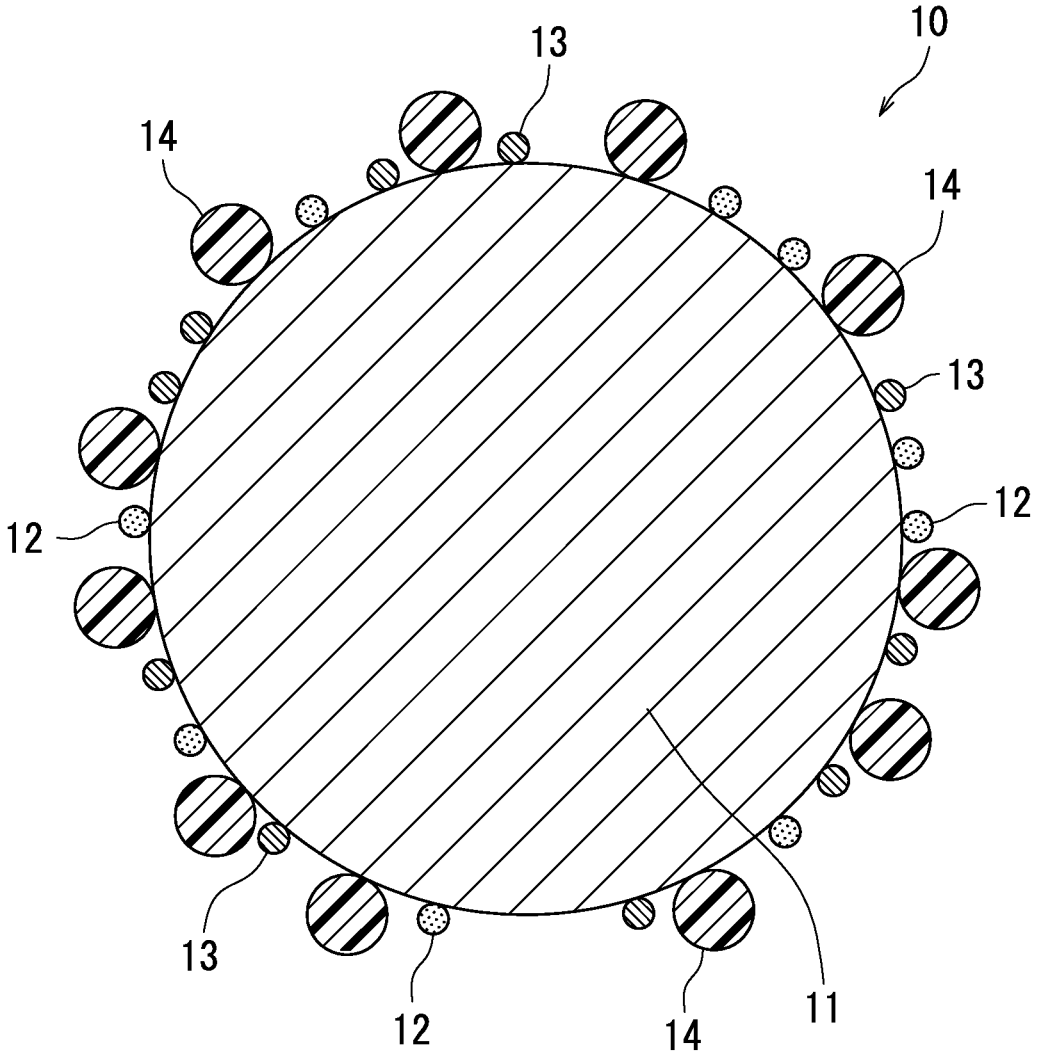
10
13
14
14
13
12
12
13
12
14
11

POSITIVELY CHARGEABLE TONER

INCORPORATION BY REFERENCE

The present application claims priority under 35 U.S.C. § 119 to Japanese Patent Application No. 2018-093829, filed on May 15, 2018. The contents of this application are incorporated herein by reference in their entirety.

BACKGROUND

The present disclosure relates to a positively chargeable toner.

A known non-magnetic one-component developing toner includes two types of hydrophobized silica powders (a positively chargeable silica powder and a negatively chargeable silica powder) as external additives.

SUMMARY

A positively chargeable toner according to the present disclosure includes toner particles. The toner particles each include a toner mother particle containing a binder resin, and an external additive adhering to a surface of the toner mother particle. The external additive includes, as external additive particles, silica particles having a number average primary particle diameter of at least 10 nm and no greater than 35 nm, titania particles having a number average primary particle diameter of at least 10 nm and no greater than 30 nm, and crosslinked resin particles having a number average particle diameter of at least 40 nm and no greater than 200 nm. The silica particles each include a silica base, and a first surface treatment layer present on a surface of the silica base. The first surface treatment layer has an alkyl group having a carbon number of at least 8 and no greater than 16, and an amino group. The titania particles each include a titania base, and a second surface treatment layer present on a surface of the titania base. The second surface treatment layer has an alkyl group having a carbon number of at least 3 and no greater than 8.

BRIEF DESCRIPTION OF THE DRAWINGS

FIGURE is a diagram illustrating an example of a cross-sectional structure of a toner particle included in a positively chargeable toner according to an embodiment of the present disclosure.

DETAILED DESCRIPTION

A preferred embodiment of the present disclosure will now be described. It is noted that a toner is a collection (such as a powder) of toner particles. An external additive is a collection (such as a powder) of external additive particles. An evaluation result (a value corresponding to a shape, a property, or the like) regarding a powder (of, more specifically, toner particles, external additives, or the like) is a number average of measured values of a considerable number of particles selected from the powder unless otherwise stated.

A measured value of a volume median diameter ($D_{50}$) of a powder is a median diameter measured using a laser diffraction/scattering particle size distribution analyzer ("LA-950" manufactured by HORIBA, Ltd.) unless otherwise stated. A number average primary particle diameter of a powder is a number average value of equivalent circle diameters (Heywood diameters: diameters each of a circle having the same area as projected area of each particle) of 100 primary particles measured under a scanning electron microscope unless otherwise stated. It is noted that a number average primary particle diameter of particles refers to a number average primary particle diameter of particles included in a powder (a number average primary particle diameter of the powder) unless otherwise stated.

Strength of chargeability refers to triboelectric charging behavior unless otherwise stated. For example, a measurement target (such as a toner) is mixed and stirred with a standard carrier (standard carrier for negatively chargeable toner: N-01, standard carrier for positively chargeable toner: P-01) available from The Imaging Society of Japan to triboelectrically charge the measurement target. An amount of charge of the measurement target is measured before and after the triboelectric charging with, for example, a compact draw-off charge measurement system ("MODEL 212HS" manufactured by Trek, Inc.). A larger difference in the amount of charge between before and after the triboelectric charging means that the measurement target has higher chargeability.

A measured value for a softening point (Tm) is a value measured using a capillary rheometer ("CFT-500D" manufactured by Shimadzu Corporation) unless otherwise stated. In an S-shaped curve (horizontal axis: temperature, vertical axis: stroke) plotted using the capillary rheometer, the softening point (Tm) is a temperature corresponding to a stroke value of "(base line stroke value+maximum stroke value)/2". A measured value for a melting point (Mp) is a temperature of a highest endothermic peak in a heat absorption curve (vertical axis: heat flow (DSC signal), horizontal axis: temperature) plotted using a differential scanning calorimeter ("DSC-6220" manufactured by Seiko Instruments Inc.) unless otherwise stated. The endothermic peak appears due to melting of a crystallized portion of a measurement target. A measured value for a glass transition point (Tg) is a value measured using a differential scanning calorimeter ("DSC-6220" manufactured by Seiko Instruments Inc.) according to "Japanese Industrial Standard (JIS) K7121-2012" unless otherwise stated. In a heat absorption curve (vertical axis: heat flow (DSC signal), horizontal axis: temperature) plotted using the differential scanning calorimeter, the glass transition point (Tg) is a temperature at an inflection point due to glass transition (specifically, a temperature at an intersection of an extrapolation of a base line and an extrapolation of an inclined portion of the curve).

A measured value for an acid value is a value measured according to "Japanese Industrial Standard (JIS) K0070-1992" unless otherwise stated.

A measured value for each of a number average molecular weight (Mn) and a mass average molecular weight (Mw) is a value measured using gel permeation chromatography unless otherwise stated.

Strength of hydrophobicity can be expressed, for example, by a contact angle with respect to a water droplet (water wettability). A larger contact angle with respect to a water droplet means stronger hydrophobicity.

An alkyl group having a carbon number of at least 3 and no greater than 8 is a linear or branched and unsubstituted group. Examples of the alkyl group having a carbon number of at least 3 and no greater than 8 include an n-propyl group, an n-butyl group, an isobutyl group, an n-pentyl group, an n-hexyl group, an n-heptyl group, and an n-octyl group.

An alkyl group having a carbon number of at least 8 and no greater than 16 is a linear or branched and unsubstituted group. Examples of the alkyl group having a carbon number of at least 8 and no greater than 16 include an n-octyl group, an n-nonyl group, an n-decyl group, an n-undecyl group, an n-dodecyl group, an n-tridecyl group, an n-tetradecyl group, an n-pentadecyl group, and an n-hexadecyl group.

In the following description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. The term "(meth)acryl" may be used as a generic term encompassing both acryl and methacryl. The term "(meth)acrylonitrile" may be used as a generic term encompassing both acrylonitrile and methacrylonitrile. The term "silica base" refers to an untreated silica particle. The term "titania base" refers to an untreated titania particle. The term "crosslinked resin" refers to a resin having a crosslinked structure. The term "crosslinked resin particle" refers to a resin particle composed of a crosslinked resin. The term "resin base" refers to an untreated resin particle (for example, a resin particle not having a surfactant adhering thereto). The term "crosslinked resin base" refers to an untreated crosslinked resin particle (for example, a crosslinked resin particle not having a surfactant adhering thereto).

Herein, both a silica base and a silica particle obtained by subjecting the silica base to a surface treatment may be referred to as the "silica particle" in some cases. Also, both a titania base and a titania particle obtained by subjecting the titania base to a surface treatment may be referred to as the "titania particle" in some cases. Both a resin base and a resin base having a surfactant adhering thereto may be referred to as a "resin particle" in some cases. Both a crosslinked resin base and a crosslinked resin base having a surfactant adhering thereto may be referred to as a "crosslinked resin particle" in some cases.

<Positively Chargeable Toner>

A positively chargeable toner (hereinafter, also simply referred to as the toner) according to the present embodiment can be suitably used for developing, for example, an electrostatic latent image. The toner according to the present embodiment is a collection (for example, a powder) of toner particles (particles each having the features described later). The toner may be used as a one-component developer. Alternatively, the toner may be mixed with a carrier using a mixer (for example, a ball mill) to prepare a two-component developer. The toner of the present embodiment is positively charged in a developing device by friction with a carrier, a development sleeve, or a blade.

The toner particles included in the toner according to the present embodiment each include a toner mother particle containing a binder resin, and an external additive adhering to the surface of the toner mother particle. The external additive includes, as external additive particles, silica particles having a number average primary particle diameter of at least 10 nm and no greater than 35 nm, titania particles having a number average primary particle diameter of at least 10 nm and no greater than 30 nm, and crosslinked resin particles having a number average primary particle diameter of at least 40 nm and no greater than 200 nm. The silica particles each include a silica base, and a first surface treatment layer present on a surface of the silica base. The first surface treatment layer has an alkyl group having a carbon number of at least 8 and no greater than 16, and an amino group. The titania particles each include a titania base, and a second surface treatment layer present on a surface of the titania base. The second surface treatment layer has an alkyl group having a carbon number of at least 3 and no greater than 8.

Since the toner according to the present embodiment has the above-described features, removal performance (cleaning performance) for residues on the surface of an image bearing member (for example, a photosensitive drum) after a transferring process, charge stability, anti-fogging performance, and a non-filming property can be improved. The reason is presumed as follows:

In general, when silica particles alone are used as an external additive of toner particles, merely a portion where the silica particle is present on the surface of each toner particle tends to be locally charged, and hence the whole surface of the toner particle is not uniformly charged. On the contrary, in the toner according to the present embodiment, the external additive includes the titania particles having a number average primary particle diameter of at least 10 nm and no greater than 30 nm in addition to the silica particles having a number average primary particle diameter of at least 10 nm and no greater than 35 nm. Therefore, in the toner according to the present embodiment, the titania particles receive charge from the surfaces of the silica particles to suppress excessive charging (overcharging) of the silica particles. Besides, the titania particles have appropriately low electrical resistance, and hence charge easily transfers among the titanium particles. Accordingly, it is presumed, in the toner according to the present embodiment, that the charge on the surfaces of the silica particles is rapidly dispersed to the titania particles. Therefore, it is presumed, in the toner according to the present embodiment, that the excessive charge on the surfaces of the silica particles is transferred to the whole surfaces of the toner particles by the titania particles, so that the whole surfaces of the toner particles can be easily uniformly charged.

Besides, in the toner according to the present embodiment, the external additive further includes the crosslinked resin particles having a number average primary particle diameter of at least 40 nm and no greater than 200 nm. The crosslinked resin particles having a number average primary particle diameter of at least 40 nm protrude beyond the silica particles and the titania particles on the surfaces of the toner particles. Therefore, in the toner according to the present embodiment, the silica particles (particles making contribution to chargeability), and the titania particles (particles making contribution to charge uniformity) can be inhibited from being embedded in the toner mother particles. In other words, the crosslinked resin particles having a number average primary particle diameter of at least 40 nm function as a spacer among the toner mother particles. In addition, the crosslinked resin particles having a number average primary particle diameter of no greater than 200 nm are inhibited from being detached from the toner mother particles, and therefore, the function as the spacer can be retained in the developing device.

Accordingly, the toner according to the present embodiment can have improved charge stability.

Besides, in the toner according to the present embodiment, the silica particles (silica particles having a number average primary particle diameter of at least 10 nm and no greater than 35 nm) included in the external additive each include the first surface treatment layer including an alkyl group having a carbon number of at least 8 and no greater than 16, and an amino group. Such silica particles seem to form a dense particle aggregation (blocking layer) between a photosensitive drum and a cleaning section for example after the toner has been transferred onto a transfer object.

Such a blocking layer can inhibit the external additive particles having a small particle diameter from passing therethrough. Besides, in the toner according to the present embodiment, the titania particles (titania particles having a number average primary particle diameter of at least 10 nm and no greater than 30 nm) included in the external additive each include the second surface treatment layer including an alkyl group having a carbon number of at least 3 and no greater than 8. Since these titania particles have fluidity, they can inhibit the external additive particles from continuously staying in the blocking layer, for example. Accordingly, the toner according to the present embodiment can have improved cleaning performance.

Furthermore, in the toner according to the present embodiment, since the external additive includes the crosslinked resin particles as described above, the toner can be inhibited from adhering to, for example, the surface of the photosensitive drum. Accordingly, the toner according to the present embodiment can have an improved non-filming property.

In the toner according to the present embodiment, the silica particles included in the external additive each include the first surface treatment layer including an alkyl group having a carbon number of at least 8 and no greater than 16, and an amino group as described above. Besides, in the toner according to the present embodiment, the titania particles included in the external additive each include the second surface treatment layer including an alkyl group having a carbon number of at least 3 and no greater than 8 as described above. Such silica particles and titania particles impart, to the toner particles, appropriate hydrophobicity, and positive chargeability suitable for image formation. Furthermore, in the toner according to the present embodiment, the external additive includes the crosslinked resin particles having the function as the spacer as described above. Therefore, the silica particles and the titania particles can be inhibited from being embedded in the toner mother particles. Accordingly, the toner according to the present embodiment can stably retain positive chargeability, and hence anti-fogging performance can be improved.

The toner particles included in the toner according to the present embodiment may be toner particles each not including a shell layer, or may be toner particles each including a shell layer (hereinafter also referred to as capsule toner particles). In each capsule toner particle, the toner mother particle includes a toner core containing a binder resin, and a shell layer covering a surface of the toner core. The shell layer contains a resin. For example, when low-melting toner cores are covered with shell layers having excellent heat resistance, heat-resistant preservability and low-temperature fixability of the toner can be both attained. An additive may be dispersed in the resin contained in the shell layer. The shell layer may cover the whole surface of the toner core, or may partially cover the surface of the toner core.

In order to obtain a toner suitable for image formation, the volume median diameter ($D_{50}$) of the toner mother particles is preferably at least 4 μm and no greater than 9 μm.

In order to further improve the cleaning performance, the charge stability, the anti-fogging performance and the non-filming property, amounts of the silica particles, the titania particles and the crosslinked resin particles with respect to 100 parts by mass of the toner mother particles preferably fall in the following ranges: The amount of the silica particles is preferably at least 1.0 part by mass and no greater than 2.0 parts by mass with respect to 100 parts by mass of the toner mother particles. The amount of the titania particles is preferably at least 0.1 parts by mass and no greater than 1.0 part by mass with respect to 100 parts by mass of the toner mother particles. The amount of the crosslinked resin particles is preferably at least 0.5 parts by mass and no greater than 1.0 part by mass with respect to 100 parts by mass of the toner mother particles.

The toner mother particles may contain, in addition to the binder resin, an internal additive (at least one of a colorant, a releasing agent, a charge control agent, and a magnetic powder) if necessary.

Now, the toner according to the present embodiment will be described in detail appropriately with reference to FIGURE.

[Features of Toner Particles]

Now, the features of each toner particle included in the toner according to the present embodiment will be described with reference to FIGURE. FIGURE illustrates an example of the cross-sectional structure of each toner particle included in the toner according to the present embodiment.

A toner particle 10 illustrated in FIGURE includes a toner mother particle 11 containing a binder resin, and an external additive adhering to the surface of the toner mother particle 11. The external additive includes, as external additive particles, silica particles 12 having a number average primary particle diameter of at least 10 nm and no greater than 35 nm, titania particles 13 having a number average primary particle diameter of at least 10 nm and no greater than 30 nm, and crosslinked resin particles 14 having a number average primary particle diameter of at least 40 nm and no greater than 200 nm.

In order to further improve the cleaning performance and the charge stability, the number average primary particle diameter of the silica particles 12 is preferably at least 16 nm and no greater than 30 nm.

In order to further improve the cleaning performance and the charge stability, the number average primary particle diameter of the titania particles 13 is preferably at least 14 nm and no greater than 21 nm.

In order to further improve the charge stability, the anti-fogging performance and the non-filming property, the number average primary particle diameter of the crosslinked resin particles 14 is preferably at least 60 nm and no greater than 140 nm.

The silica particles 12 each include a silica base (not shown), and a first surface treatment layer (not shown) present on a surface of the silica base. The first surface treatment layer has an alkyl group having a carbon number of at least 8 and no greater than 16, and an amino group. The first surface treatment layer can be obtained by, for example, surface-treating the silica base with alkylalkoxysilane (more specifically, alkylalkoxysilane including an alkyl group having a carbon number of at least 8 and no greater than 16), and an amino group-containing surface treatment agent described later.

The titania particles 13 each include a titania base (not shown), and a second surface treatment layer (not shown) present on a surface of the titania base. The second surface treatment layer has an alkyl group having a carbon number of at least 3 and no greater than 8. The second surface treatment layer is obtained by, for example, surface-treating the titania base with alkylalkoxysilane (more specifically, alkylalkoxysilane including an alkyl group having a carbon number of at least 3 and no greater than 8) described later.

[Components of Toner Particles]

Now, components of the toner particles included in the toner according to the present embodiment will be described.

(Binder Resin)

In order to improve the low-temperature fixability of the toner, the toner mother particles preferably contain a thermoplastic resin as the binder resin, and more preferably contain a thermoplastic resin in a ratio of at least 85% by mass of the whole binder resin. Examples of the thermoplastic resin include styrene-based resins, acrylic acid ester-based resins, olefin-based resins (more specifically, polyethylene resins, polypropylene resins and the like), vinyl resins (more specifically, vinyl chloride resins, polyvinyl alcohol, vinyl ether resins, N-vinyl resins and the like), polyester resins, polyamide resins, and urethane resins. Besides, copolymers of any of these resins, namely, copolymers obtained by introducing an arbitrary repeating unit into any of the above-described resins, (more specifically, styrene-acrylic acid ester-based resins, styrene-butadiene-based resins and the like) can be used as the binder resin.

A thermoplastic resin is obtained by addition polymerization, copolymerization, or condensation polymerization of at least one thermoplastic monomer. Incidentally, a thermoplastic monomer is a monomer that can form a thermoplastic resin by homopolymerization (more specifically, an acrylic acid ester-based monomer, a styrene-based monomer or the like), or monomers that can form a thermoplastic resin by condensation polymerization (for example, a combination of a polyhydric alcohol and a polycarboxylic acid that can form a polyester resin by condensation polymerization).

In order to improve the low-temperature fixability of the toner, the toner mother particles preferably contain a polyester resin as the binder resin. As the polyester resin, a mixed resin of a crystalline polyester resin and a non-crystalline polyester resin is preferably used. When the toner mother particles contain a crystalline polyester resin and a non-crystalline polyester resin as the binder resin, the low-temperature fixability of the toner can be improved with dispersibility of the internal additive improved. In this case, a mixing ratio between the crystalline polyester resin and the non-crystalline polyester resin is not especially limited, and these resins may be mixed in a ratio of, for example, at least 1 part by mass and no greater than 30 parts by mass of the crystalline polyester resin with respect to 100 parts by mass of the non-crystalline polyester resin.

In order to cause the toner to have an appropriate sharp melt property, the toner mother particles preferably contain, as the binder resin, a crystalline polyester resin having a crystallinity index of at least 0.90 and no greater than 1.20. The crystallinity index of the crystalline polyester resin can be adjusted by changing the type or the amount (mixing ratio) of a material to be used for synthesizing the crystalline polyester resin. It is noted that a crystallinity index of a resin corresponds to a ratio (Tm/Mp) of a softening point (Tm; unit: ° C.) of the resin to a melting point (Mp; unit: ° C.) of the resin. Many of non-crystalline resins have melting points that cannot be clearly measured. Therefore, a resin whose endothermic peak cannot be clearly determined on a heat absorption curve measured using a differential scanning calorimeter can be determined as a non-crystalline resin.

A polyester resin can be obtained by condensation polymerization of at least one polyhydric alcohol and at least one polycarboxylic acid. Examples of an alcohol to be used for synthesizing a polyester resin include dihydric alcohols (more specifically, aliphatic diol, bisphenol and the like) and trihydric or higher-hydric alcohols described below. Examples of a carboxylic acid to be used for synthesizing a polyester resin include di-basic carboxylic acids and tri-basic or higher-basic carboxylic acids described below. It is noted that a polycarboxylic acid derivative capable of forming an ester bond by condensation polymerization, such as a polycarboxylic acid anhydride, or a polycarboxylic acid halide, may be used instead of a polycarboxylic acid.

Examples of preferable aliphatic diols include diethylene glycol, triethylene glycol, neopentyl glycol, 1,2-propanediol, α,ω-alkanediol (more specifically, ethylene glycol, 1,3-propanediol, 1,4-butanediol, 1,5-pentanediol, 1,6-hexanediol, 1,7-heptanediol, 1,8-octanediol, 1,9-nonanediol, 1,12-dodecanediol or the like), 2-butene-1,4-diol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, a bisphenol A ethylene oxide adduct, and a bisphenol A propylene oxide adduct.

Examples of preferable trihydric or higher-hydric alcohols include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable di-basic carboxylic acids include maleic acid, fumaric acid, citraconic acid, itaconic acid, glutaconic acid, phthalic acid, isophthalic acid, terephthalic acid, cyclohexane dicarboxylic acid, adipic acid, sebacic acid, azelaic acid, malonic acid, succinic acid, alkyl succinic acid (more specifically, n-butyl succinic acid, isobutyl succinic acid, n-octyl succinic acid, n-dodecyl succinic acid, isododecyl succinic acid or the like), and alkenyl succinic acid (more specifically, n-butenyl succinic acid, isobutenyl succinic acid, n-octenyl succinic acid, n-dodecenyl succinic acid, isododecenyl succinic acid or the like).

Examples of preferable tri-basic or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylene carboxy propane, 1,2,4-cyclohexanetricarboxylic acid, tetra(methylenecarboxyl) methane, 1,2,7,8-octanetetracarboxylic acid, pyromellitic acid, and Empol trimer acid.

Examples of preferable polyhydric alcohols to be used for synthesizing a non-crystalline polyester resin include bisphenol (more specifically, a bisphenol A ethylene oxide adduct, a bisphenol A propylene oxide adduct or the like). Examples of preferable polycarboxylic acids to be used for synthesizing a non-crystalline polyester resin include aromatic dicarboxylic acid (more specifically, terephthalic acid or the like), and unsaturated dicarboxylic acid (more specifically, fumaric acid or the like).

Example of preferable polyhydric alcohols to be used for synthesizing a crystalline polyester resin includes α,ω-alkanediol having a carbon number of at least 4 and no greater than 8 (more specifically, 1,4-butanediol, 1,6-hexanediol or the like). Examples of preferable polycarboxylic acids to be used for synthesizing a crystalline polyester includes α,ω-alkanedicarboxylic acid having a carbon number of at least 4 and no greater than 12 (including carbon atoms of two carboxyl groups) (more specifically, succinic acid, sebacic acid, 1,10-decanedicarboxylic acid or the like).

Besides, when the binder resin contains a crystalline polyester resin and a non-crystalline polyester resin, the binder resin preferably further contains a styrene-acrylic acid-based resin. A styrene-acrylic acid-based resin is a copolymer of at least one styrene-based monomer and at least one acrylic acid-based monomer. When the binder resin contains a styrene-acrylic acid-based resin, the charge stability of the resultant toner can be further improved.

Examples of the styrene-based monomer to be used for synthesizing a styrene-acrylic acid-based resin include styrene, alkylstyrenes, hydroxystyrenes, and halogenated styrenes. Examples of alkylstyrenes include α-methylstyrene, m-methylstyrene, p-methylstyrene, p-ethylstyrene, and 4-t-butylstyrene. Examples of hydroxystyrenes include p-hydroxystyrene, and m-hydroxystyrene. Examples of halogenated styrenes include α-chlorostyrene, o-chlorostyrene, m-chlorostyrene, and p-chlorostyrene.

Examples of the acrylic acid-based monomer to be used for synthesizing a styrene-acrylic acid-based resin include (meth)acrylic acid, (meth)acrylamide, (meth)acrylonitrile, alkyl (meth)acrylates, and hydroxyalkyl (meth)acrylates. Examples of alkyl (meth)acrylates include methyl (meth) acrylate, ethyl (meth)acrylate, n-propyl (meth)acrylate, isopropyl (meth)acrylate, n-butyl (meth)acrylate, isobutyl (meth)acrylate, and 2-ethylhexyl (meth)acrylate. Examples of hydroxyalkyl (meth)acrylates include 2-hydroxyethyl (meth)acrylate, 3-hydroxypropyl (meth)acrylate, 2-hydroxypropyl (meth)acrylate, and 4-hydroxybutyl (meth) acrylate.

In general, when the binder resin of the toner mother particles contains a crystalline resin (such as a crystalline polyester resin), filming tends to be easily caused. The toner according to the present embodiment is, however, excellent in non-filming property, and therefore, occurrence of filming can be inhibited even when the binder resin of the toner mother particles contains a crystalline resin.

(Colorant)

The toner mother particles may contain a colorant. As the colorant, any of known pigments or dyes can be used in accordance with the color of the toner. In order to form a high quality image with the toner, the amount of the colorant is preferably at least 1 part by mass and no greater than 20 parts by mass with respect to 100 parts by mass of the binder resin.

The toner mother particles may contain a black colorant. An example of the black colorant is carbon black. Alternatively, the black colorant may be a colorant whose color is adjusted to black using a yellow colorant, a magenta colorant, and a cyan colorant.

The toner mother particles may contain a non-black colorant. Examples of the non-black colorant include a yellow colorant, a magenta colorant, and a cyan colorant.

As the yellow colorant, at least one compound selected from the group consisting of, for example, condensed azo compounds, isoindolinone compounds, anthraquinone compounds, azo metal complexes, methine compounds, and arylamide compounds can be used. Examples of the yellow colorant include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C.I. Bat Yellow.

As the magenta colorant, at least one compound selected from the group consisting of, for example, condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can be used. Examples of the magenta colorant include C.I. Pigment Red (2, 3, 5, 6, 7, 19, 23, 48:2, 48:3, 48:4, 57:1 81:1, 122, 144, 146, 150, 166, 169, 177, 184, 185, 202, 206, 220, 221, and 254).

As the cyan colorant, at least one compound selected from the group consisting of, for example, copper phthalocyanine compounds, anthraquinone compounds, and basic dye lake compounds can be used. Examples of the cyan colorant include C.I. Pigment Blue (1, 7, 15, 15:1, 15:2, 15:3, 15:4, 60, 62, and 66), phthalocyanine blue, C.I. Bat Blue, and C.I. Acid Blue.

(Releasing Agent)

The toner mother particles may contain a releasing agent. The releasing agent is used for purpose of, for example, improving offset resistance of the toner. In order to improve the offset resistance of the toner, the amount of the releasing agent is preferably at least 1 part by mass and no greater than 20 parts by mass with respect to 100 parts by mass of the binder resin.

Examples of the releasing agent include ester wax, polyolefin wax (more specifically, polyethylene wax, polypropylene wax or the like), microcrystalline wax, fluororesin wax, Fischer-Tropsch wax, paraffin wax, candelilla wax, montan wax, and castor wax. Examples of ester wax include natural ester wax (more specifically, carnauba wax, rice wax and the like), and synthetic ester wax. In the present embodiment, merely one releasing agent may be singly used, or a plurality of releasing agents may be used in combination.

In order to improve compatibility between the binder resin and the releasing agent, a compatibilizer may be added to the toner mother particles.

(Charge Control Agent)

The toner mother particles may contain a charge control agent. The charge control agent is used for purpose of, for example, improving charge stability and a charge rise characteristic of the toner. The charge rise characteristic of the toner is an indicator as to whether or not the toner can be charged to a prescribed charge level in a short period of time. When a positively chargeable charge control agent is contained in the toner mother particles, the cationic property (positive chargeability) of the toner mother particles can be enhanced.

Examples of the positively chargeable charge control agent include azine compounds such as pyridazine, pyrimidine, pyrazine, 1,2-oxazine, 1,3-oxazine, 1,4-oxazine, 1,2-thiazine, 1,3-thiazine, 1,4-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes such as azine fast red FC, azine fast red 12BK, azine violet BO, azine brown 3G azine light brown GR, azine dark green BH/C, azine deep black EW, and azine deep black 3RL; acid dyes such as nigrosin BK, nigrosin NB, and nigrosin Z; alkoxylated amine; alkylamide; quaternary ammonium salts such as benzyldecylhexylmethylammonium chloride, decyltrimethylammonium chloride, 2-(methacryloyloxy)ethyl trimethylammonium chloride, and dimethylaminopropyl acrylamide, methyl chloride quaternary salt; and resins containing a quaternary ammonium cationic group. Merely one of these charge control agents may be used, or at least two of these charge control agents may be used in combination.

A content of the charge control agent is, for further improving the charge stability, preferably at least 0.1 parts by mass and no greater than 20 parts by mass with respect to 100 parts by mass of the binder resin.

(Magnetic Powder)

The toner mother particles may contain a magnetic powder. Examples of a material of the magnetic powder include ferromagnetic metals (more specifically, iron, cobalt, nickel and the like) and alloys thereof, ferromagnetic metal oxides (more specifically, ferrite, magnetite, chromium dioxide and the like), and a material having been subjected to a ferromagnetization treatment (more specifically, a carbon material having a ferromagnetic property imparted by a heat treatment, or the like). In the present embodiment, merely one magnetic powder may be singly used, or a plurality of magnetic powders may be used together.

(External Additive)

The toner particles included in the toner according to the present embodiment include the external additive adhering to the surfaces of the toner mother particles. The external additive includes silica particles (hereinafter also referred to as the specific silica particles), titania particles (hereinafter also referred to as the specific titania particles), and crosslinked resin particles (hereinafter also referred to as the specific crosslinked resin particles).

(Specific Silica Particles)

The specific silica particles are silica particles each including a silica base, and a first surface treatment layer present on a surface of the silica base, and having a number average primary particle diameter of at least 10 nm and no greater than 35 nm. The silica base may be a silica particle prepared by a dry method (more specifically, a combustion method, a deflagration method or the like), or a silica particle prepared by a wet method (more specifically, a precipitation method, a gel method, a sol-gel method or the like).

The first surface treatment layer has an alkyl group having a carbon number of at least 8 and no greater than 16, and an amino group. The first surface treatment layer is obtained by, for example, surface-treating the silica base with a surface treatment agent. Examples of the surface treatment agent include an alkylalkoxysilane (more specifically, an alkylalkoxysilane including an alkyl group having a carbon number of at least 8 and no greater than 16), and an amino-group-containing surface treatment agent.

An alkylalkoxysilane is a compound in which at least one alkyl group and at least two alkoxy groups are directly bonded to a silicon atom. In order to easily surface-treating the silica bases, the alkylalkoxysilane is preferably a monoalkyltrialkoxysilane in which one alkyl group and three alkoxy groups are directly bonded to a silicon atom.

The amino-group-containing surface treatment agent refers to a compound capable of introducing an amino group into a surface being treated. In order to easily surface-treating the silica bases, the amino-group-containing surface treatment agent is preferably at least one selected from aminoalkoxysilanes and amino-modified silicone oils.

An aminoalkoxysilane refers to a compound in which at least one amino group-containing functional group is contained in one molecule, and at least two alkoxy groups are directly bonded to a silicon atom. In order to easily surface-treating the silica bases, the aminoalkoxysilane is preferably a compound in which one amino group-containing functional group is contained in one molecule, and three alkoxy groups are directly bonded to a silicon atom. In order to further improve the anti-fogging performance, the amino group-containing functional group is preferably an aminoalkyl group, and more preferably a 3-aminopropyl group.

The amino-modified silicone oil refers to a silicone-based polymer (a polymer having a siloxane bond) having molecules partially modified with an amino group.

Examples of the alkylalkoxysilane to be used for introducing, into the silica base, an alkyl group having a carbon number of at least 8 and no greater than 16 include octyltrimethoxysilane (more specifically, n-octyltrimethoxysilane or the like), octyltriethoxysilane (more specifically, n-octyltriethoxysilane or the like), decyltrimethoxysilane (more specifically, n-decyltrimethoxysilane or the like), decyltriethoxysilane (more specifically, n-decyltriethoxysilane or the like), dodecyltrimethoxysilane (more specifically, n-dodecyltrimethoxysilane or the like), dodecyltriethoxysilane (more specifically, n-dodecyltriethoxysilane or the like), tetradecyltrimethoxysilane (more specifically, n-tetradecyltrimethoxysilane or the like), tetradecyltriethoxysilane (more specifically, n-tetradecyltriethoxysilane or the like), hexadecyltrimethoxysilane (more specifically, n-hexadecyltrimethoxysilane or the like), and hexadecyltriethoxysilane (more specifically, n-hexadecyltriethoxysilane or the like).

Examples of the aminoalkoxysilane to be used for introducing an amino group into the silica base include 3-aminopropyltrialkoxysilane (more specifically, 3-aminopropyltrimethoxysilane, 3-aminopropyltriethoxysilane or the like), 3-(2-aminoethylamino)propyltrialkoxysilane (more specifically, 3-(2-aminoethylamino)propyltrimethoxy silane, 3-(2-aminoethylamino)propyltriethoxysilane or the like), and 3-(2-aminoethylamino)propyldialkoxymethylsilane (more specifically, 3-(2-aminoethylamino)propyldimethoxymethylsilane or the like).

Examples of a method for surface-treating the silica bases include a first method in which the surface treatment agent is dropped or sprayed onto the silica bases under stirring, and the silica bases thus coated with the surface treatment agent are heated, and a second method in which the silica bases are added to a solution of the surface treatment agent under stirring, and the silica bases thus coated with the surface treatment agent are heated. The surface treatment agent may be dissolved in an organic solvent. Alternatively, a commercially available surface treatment agent may be diluted with an organic solvent. When two surface treatment agents (for example, an alkylalkoxysilane and an amino group-containing surface treatment agent) are used together, the silica bases may be treated with one of the surface treatment agents, and then treated with the other of the surface treatment agents, or the silica bases may be surface-treated simultaneously with the two surface treatment agents. A temperature and a time for heating the silica bases coated with the surface treatment agent are not especially limited as long as a reaction (such as a dehydration condensation reaction) between the surfaces of the silica bases and the surface treatment agent is carried out.

When the silica bases are surface-treated with an alkylalkoxysilane, for example, a dehydration condensation reaction is caused between a hydroxyl group generated by hydrolysis, with a water content, of an alkoxy group of the alkylalkoxysilane and a hydroxyl group present on the surface of each silica base. Through this reaction, an alkyl group (an alkyl group having a carbon number of at least 8 and no greater than 16) is imparted to the surface of the silica base. Alternatively, when the silica bases are surface-treated with an aminoalkoxysilane, for example, a dehydration condensation reaction is caused between a hydroxyl group generated by hydrolysis, with a water content, of an alkoxy group of the aminoalkoxysilane and a hydroxyl group present on the surface of each silica base. Through this reaction, an amino group is imparted to the surface of the silica base.

(Specific Titania Particles)

The specific titania particles are titania particles each including a titania base, and a second surface treatment layer present on a surface of the titania base, and having a number average primary particle diameter of at least 10 nm and no greater than 30 nm. The titania base may be an anatase-type titania particle, or a rutile-type titania particle.

The second surface treatment layer has an alkyl group having a carbon number of at least 3 and no greater than 8. The second surface treatment layer is obtained by, for example, surface-treating the titania base with a surface treatment agent. An example of the surface treatment agent is an alkylalkoxysilane (more specifically, an alkylalkoxysilane including an alkyl group having a carbon number of at least 3 and no greater than 8). In order to easily surface-treating the titania bases, the alkylalkoxysilane is preferably a monoalkyltrialkoxysilane in which one alkyl group and three alkoxy groups are directly bonded to a silicon atom.

Examples of the alkylalkoxysilane to be used for introducing, into the titania base, an alkyl group having a carbon number of at least 3 and no greater than 8 include propyltrimethoxysilane (more specifically, n-propyltrimethoxysilane, isopropyltrimethoxysilane or the like), propyltriethoxysilane (more specifically, n-propyltriethoxysilane, isopropyltriethoxysilane or the like), butyltrimethoxysilane (more specifically, n-butyltrimethoxysilane, isobutyltrimethoxysilane or the like), butyltriethoxysilane (more specifically, n-butyltriethoxysilane, isobutyltriethoxysilane or the like), hexyltrimethoxysilane (more specifically, n-hexyltrimethoxysilane or the like), hexyltriethoxysilane (more specifically, n-hexyltriethoxysilane or the like), octyltrimethoxysilane (more specifically, n-octyltrimethoxysilane or the like), and octyltriethoxysilane (more specifically, n-octyltriethoxysilane or the like).

Examples of a method for surface-treating the titania bases include a first method in which the surface treatment agent is dropped or sprayed onto the titania bases under stirring, and the titania bases thus coated with the surface treatment agent are heated, and a second method in which the titania bases are added to a solution of the surface treatment agent under stirring, and the titania bases thus coated with the surface treatment agent are heated. The surface treatment agent may be dissolved in an organic solvent. Alternatively, a commercially available surface treatment agent may be diluted with an organic solvent. A temperature and a time for heating the titania bases coated with the surface treatment agent are not especially limited as long as a reaction (such as a dehydration condensation reaction) between the surfaces of the titania bases and the surface treatment agent is carried out.

When the titania bases are surface-treated with an alkylalkoxysilane, for example, a dehydration condensation reaction is caused between a hydroxyl group generated by hydrolysis, with a water content, of an alkoxy group of the alkylalkoxysilane and a hydroxyl group present on the surface of each titania base. Through this reaction, an alkyl group (an alkyl group having a carbon number of at least 3 and no greater than 8) is imparted to the surface of the titania base.

(Specific Crosslinked Resin Particles)

The specific crosslinked resin particles are crosslinked resin particles having a number average primary particle diameter of at least 40 nm and no greater than 200 nm. In order to easily adjust the number average primary particle diameter to fall in the range of at least 40 nm and no greater than 200 nm, the specific crosslinked resin particles are preferably resin particles containing a polymer (hereinafter also referred to as the specific crosslinked polymer) of a styrene-based monomer, an acrylic acid-based monomer, and a crosslinking agent having at least two unsaturated bonds (for example, carbon-carbon double bonds). In order to further improve the charge stability, the anti-fogging performance and the non-filming property, the specific crosslinked resin particles preferably contain, as a component resin, the specific crosslinked polymer alone.

Examples of the styrene-based monomer to be used for synthesizing the specific crosslinked polymer include monomers the same as the styrene-based monomers to be used for synthesizing the styrene-acrylic acid-based resin described above as an example of the binder resin. In order to further improve the non-filming property, the styrene-based monomer to be used for synthesizing the specific crosslinked polymer is preferably styrene.

Examples of the acrylic acid-based monomer to be used for synthesizing the specific crosslinked polymer include monomers the same as the acrylic acid-based monomers to be used for synthesizing the styrene-acrylic acid-based resin described above as an example of the binder resin. In order to further improve the non-filming property, the acrylic acid-based monomer to be used for synthesizing the specific crosslinked polymer is preferably an alkyl (meth)acrylate, and more preferably methyl methacrylate.

Examples of the crosslinking agent having at least two unsaturated bonds to be used for synthesizing the specific crosslinked polymer include N,N'-methylenebisacrylamide, divinylbenzene, ethylene glycol diacrylate, ethylene glycol dimethacrylate, diethylene glycol diacrylate, tetraethylene glycol diacrylate, polyethylene glycol diacrylate, 1,4-butanedioldiacrylate, 1,6-hexanedioldiacrylate, tripropylene glycol diacrylate, trimethylolpropane triacrylate, pentaerythritol triacrylate, pentaerythritol tetraacrylate, 1,4-butanediol dimethacrylate, and 1,6-hexanediol dimethacrylate. In order to adjust the number average primary particle diameter of the specific crosslinked resin particles to fall in the range of at least 40 nm and no greater than 200 nm, the crosslinking agent having at least two unsaturated bonds is preferably divinylbenzene.

In order to further improve the charge stability, the anti-fogging performance and the non-filming property, the specific crosslinked resin particles preferably contain a polymer of styrene, an alkyl (meth)acrylate, and a crosslinking agent having at least two unsaturated bonds, and more preferably contain a polymer of styrene, methyl methacrylate, and divinylbenzene.

Examples of a method for forming the specific crosslinked resin particles include an emulsion polymerization method, a seed polymerization method, and a dispersion polymerization method. Examples of a polymerization initiator usable in these methods include an inorganic peroxide (more specifically, ammonium persulfate, hydrogen peroxide or the like), an organic peroxide (more specifically, t-butyl peroxide, cumene hydroperoxide or the like), and an azo compound (more specifically, azobisisobutyronitrile, 2,2'-azobis(2-amidinopropane)dihydrochloride or the like). The polymerization initiator is preferably an inorganic peroxide, and particularly preferably ammonium persulfate.

In order to further improve the charge stability and the anti-fogging performance, the specific crosslinked resin particles each preferably include a crosslinked resin base, and a cationic surfactant adhering to a surface of the crosslinked resin base. An example of a method for forming specific crosslinked resin particles each including a crosslinked resin base containing the specific crosslinked polymer, and a cationic surfactant adhering to the surface of the crosslinked resin base will now be described. First, a polymerization reaction for forming the specific crosslinked polymer is carried out in a liquid containing a styrene-based monomer, an acrylic acid-based monomer, a crosslinking agent having at least two unsaturated bonds, and a cationic surfactant. Subsequently, a reaction product is taken out of the liquid after the reaction, and then the product is dried without washing (or without completely removing the cationic surfactant present on the surface of the product in a washing process). By this method, the specific crosslinked resin particles each including the crosslinked resin base containing the specific crosslinked polymer, and the cationic surfactant adhering to the crosslinked resin base (i.e., the resin particles each including the crosslinked resin base surface-treated with the cationic surfactant) are obtained. The number average primary particle diameter of the specific crosslinked resin particles can be adjusted by, for example, changing at least one of the amount of the crosslinking agent to be used, the type of the cationic surfactant, and the amount of the cationic surfactant to be used. The cationic surfactant is preferably an alkyltrimethylammonium salt including an alkyl group having a carbon number of at least 10 and no greater than 25, more preferably a stearyltrimethylammonium salt, and further preferably a stearyltrimethylammonium chloride.

It is noted that the cationic surfactant is not essential in the method for forming the specific crosslinked resin particles. For example, an anionic surfactant may be used instead of the cationic surfactant in the above-described method. In this case, specific crosslinked resin particles each including the crosslinked resin base containing the specific crosslinked polymer, and the anionic surfactant adhering to the surface of the crosslinked resin base are obtained. When an anionic surfactant is used instead of a cationic surfactant, the number average primary particle diameter of the specific crosslinked resin particles can be adjusted by, for example, changing at least one of the amount of the crosslinking agent to be used, the type of the anionic surfactant, and the amount of the anionic surfactant to be used. The anionic surfactant is preferably an alkylbenzenesulfonate including an alkyl group having a carbon number of at least 10 and no greater than 25, more preferably a dodecylbenzenesulfonate, and further preferably sodium dodecylbenzenesulfonate.

(Preferable Combination of External Additive Particles)

In order to further improve the cleaning performance, the charge stability, the anti-fogging performance and the non-filming property, the external additive preferably includes specific silica particles each including a first surface treatment layer including an alkyl group having a carbon number of 8 and an amino group, specific titania particles each including a second surface treatment layer including an alkyl group having a carbon number of 3, and specific crosslinked resin particles each including a crosslinked resin base and a cationic surfactant adhering to the surface of the crosslinked resin base.

(Additional External Additive Particles)

The external additive may include, as the external additive particles, the specific silica particles, the specific titania particles and the specific crosslinked resin particles alone, or may further include particles of an additional external additive in addition to the specific silica particles, the specific titania particles and the specific crosslinked resin particles. In order to keep good fluidity of the toner, particles of the additional external additive are preferably particles of a metal oxide (more specifically, alumina, magnesium oxide, zinc oxide or the like) different from the titania particles. In order to further improve the cleaning performance, the charge stability, the anti-fogging performance and the non-filming property, however, the external additive preferably includes, as the externa additive particles, the specific silica particles, the specific titania particles and the specific crosslinked resin particles alone.

In order to cause the external additive to sufficiently exhibit the function thereof with the external additive inhibited from being detached from the toner mother particles, an amount of the external additive (when particles of an additional external additive are used, the total amount of the specific silica particles, the specific titania particles, the specific crosslinked resin particles and the particles of the additional external additive) is preferably at least 1.6 parts by mass and no greater than 10.0 parts by mass with respect to 100 parts by mass of the toner mother particles.

<Method for Producing Toner>

Next, a suitable method for producing the toner according to the present embodiment will be described. In the following description, the components described above with respect to the toner according the present embodiment will not be redundantly described.

[Preparation of Toner Mother Particles]

First, toner mother particles are prepared by an aggregation method or a pulverization method.

The aggregation method includes, for example, an aggregation step and a coalescence step. In the aggregation step, fine particles containing components of the toner mother particles are caused to aggregate in an aqueous medium to form aggregated particles. In the coalescence step, the components contained in the aggregated particles are caused to coalesce in the aqueous medium to obtain the toner mother particles.

Next, the pulverization method will be described. The toner mother particles can be relatively easily prepared, and in addition, manufacturing cost can be reduced by the pulverization method. When the toner mother particles are prepared by the pulverization method, the preparation of the toner mother particles includes, for example, a melt kneading step and a pulverization step. The preparation of the toner mother particles may further include a mixing step before the melt kneading step. Besides, the preparation of the toner mother particles may further include at least one of a fine pulverization step and a classification step after the pulverization step.

In the mixing step, a binder resin and an internal additive used if necessary are mixed to obtain a mixture. In the melt kneading step, a toner material is melt-kneaded to obtain a melt-kneaded product. The toner material is, for example, the mixture obtained through the mixing step. In the pulverization step, the obtained melt kneaded product is cooled to, for example, room temperature (25° C.) and then pulverized to obtain a pulverized product. When the diameter of the pulverized product obtained through the pulverization step needs to be reduced, a step of further pulverizing the pulverized product (i.e., the fine pulverization step) may be performed. Besides, in order to equalize the size of the pulverized product, a step of classifying the pulverized product (i.e., the classification step) may be performed. Through these steps, the toner mother particles are obtained as the pulverized product.

[External Additive Addition]

Thereafter, the obtained toner mother particles and an external additive are mixed using a mixer to cause the external additive to adhere to the surfaces of the toner mother particles. The external additive at least includes specific silica particles, specific titania particles, and specific crosslinked resin particles. The mixer is, for example, an FM mixer (manufactured by Nippon Coke & Engineering Co., Ltd.). In this manner, a toner including toner particles is produced.

Examples

Now, examples of the present disclosure and comparative examples will be described. It is noted that a scanning electron microscope "JSM-7401F" manufactured by JEOL Ltd. was used for measurement of the number average primary particle diameter of a powder.

<Synthesis of Composite Resin of Crystalline Polyester Resin and Styrene-Acrylic Acid Copolymer>

A 10-L four-necked flask equipped with a thermometer (thermocouple), a dehydration tube, a nitrogen inlet tube, and a stirrer was charged with 2643 g of 1,6-hexanediol, 864 g of 1,4-butanediol, and 2945 g of succinic acid, and then, the temperature within the flask was increased to 160° C. to dissolve the flask contents. Subsequently, a mixed solution of 1831 g of styrene, 161 g of acrylic acid, and 110 g of dicumyl peroxide was added into the flask through a dropping funnel in a dropwise manner over 1 hour. Thereafter, the flask contents were reacted for 1 hour under a nitrogen atmosphere at a temperature of 170° C., and then, unreacted portions of styrene and acrylic acid were removed therefrom over 1 hour under a reduced pressure atmosphere (pressure: 8.3 kPa) at a temperature of 80° C. Thereafter, the pressure within the flask was returned to atmospheric pressure, 40 g of tin(II) 2-ethylhexanoate and 3 g of gallic acid were put into the flask, and then, the flask contents were reacted for 8 hours under a nitrogen atmosphere at a temperature of 210° C. Subsequently, the flask contents were reacted for 1 hour under a reduced pressure atmosphere (pressure: 8.3 kPa) at a temperature of 210° C. to obtain a composite resin of a crystalline polyester resin and a styrene-acrylic acid copolymer (hereinafter referred to as the composite resin R1). The composite resin R1 had a Tm of 92° C., an Mp of 96° C., and a crystallinity index (Tm/Mp) of 0.96.

<Preparation of Silica Particles>

Silica particles 51 to S9 shown in Table 1 were respectively prepared. The silica particles 51 to S9 were silica particles surface-treated by the first method described above respectively under surface treatment conditions shown in Table 1. Besides, in the preparation of the silica particles 51 to S8 using two surface treatment agents, the two surface treatment agents were simultaneously used for treating silica bases. Manufacturers of silica bases shown in Table 1 were all Nippon Aerosil Co., Ltd. In Table 1, manufacturers of silane compounds listed in the column of "Alkylalkoxysilane", and 3-aminopropyltriethoxysilane were all Tokyo Chemical Industry Co., Ltd. As an amino-modified silicone oil shown in Table 1, "KF-857" manufactured by Shin-Etsu Chemical Co., Ltd was used.

It is noted that "AEROSIL" shown in Table 1 is a registered Japanese trademark. In Table 1, a numerical value in parentheses appended to each silane compound in the column of "Alkylalkoxysilane" corresponds to the carbon number of an alkyl group (an alkyl group contained in a first surface treatment layer after surface treatment) of the silane compound. In Table 1, "Particle Diameter" refers to a number average primary particle diameter. With respect to the number average primary particle diameter of the silica particles shown in Table 1, the same measurement result was obtained also when the measurement was performed on a powder of silica particles separated from toner particles after producing a toner by a method described below.

TABLE 1

| | | Surface Treatment Agent | | Surface Treatment Conditions | | |
|---|---|---|---|---|---|---|
| Silica Particles | Silica Bases | Alkylalkoxysilane | Amino Group-containing Surface Treatment Agent | Heating Temperature [° C.] | Heating Time [min] | Particle Diameter [nm] |
| S1 | AEROSIL 50 | n-Octyltrimethoxysilane (8) | 3-Aminopropyltriethoxysilane | 250 | 120 | 30 |
| S2 | AEROSIL 130 | n-Decyltrimethoxysilane (10) | 3-Aminopropyltriethoxysilane | 250 | 120 | 16 |
| S3 | AEROSIL 50 | n-Hexadecyltrimethoxysilane (16) | Amino-modified Silicone Oil | 250 | 120 | 30 |
| S4 | AEROSIL 90G | n-Octyltrimethoxysilane (8) | 3-Aminopropyltriethoxysilane | 250 | 120 | 20 |
| S5 | AEROSIL 130 | n-Hexadecyltrimethoxysilane (16) | Amino-modified Silicone Oil | 250 | 120 | 16 |
| S6 | AEROSIL 90G | n-Decyltrimethoxysilane (10) | 3-Aminopropyltriethoxysilane | 250 | 120 | 20 |
| S7 | AEROSIL OX50 | Isobutyltrimethoxysilane (4) | 3-Aminopropyltriethoxysilane | 250 | 120 | 40 |
| S8 | AEROSIL 90G | n-Octyltrimethoxysilane (8) | Amino-modified Silicone Oil | 250 | 120 | 20 |
| S9 | AEROSIL 50 | n-Hexadecyltrimethoxysilane (16) | None | 250 | 120 | 30 |

<Preparation of Titania Particles>

Titania particles T1 to T6 shown in Table 2 were respectively prepared. The titania particles T1 to T6 were titania particles surface-treated by the first method described above respectively under surface treatment conditions shown in Table 2. Manufacturers of titania bases shown in Table 2 were all Nippon Aerosil Co., Ltd. Manufacturers of surface treatment agents shown in Table 2 were all Tokyo Chemical Industry Co., Ltd.

It is noted that "AEROXIDE" shown in Table 2 is a registered Japanese trademark. In Table 2, a numerical value in parentheses appended to each silane compound in the column of "Surface Treatment Agent" corresponds to the carbon number of an alkyl group (an alkyl group contained in a second surface treatment layer after surface treatment) of the silane compound. In Table 2, "Particle Diameter" refers to a number average primary particle diameter. With respect to the number average primary particle diameter of the titania particles shown in Table 2, the same measurement result was obtained also when the measurement was performed on a powder of titania particles separated from toner particles after producing a toner by the method described below.

TABLE 2

| Titania Particles | Titania Bases | Surface Treatment Agent | Surface Treatment Conditions: Heating Temperature [° C.] | Heating Time [min] | Particle Diameter [nm] |
|---|---|---|---|---|---|
| T1 | AEROXIDE $TiO_2$ P25 | n-Propyltrimethoxysilane (3) | 250 | 120 | 21 |
| T2 | AEROXIDE $TiO_2$ P90 | n-Octyltrimethoxysilane (8) | 250 | 120 | 14 |
| T3 | AEROXIDE $TiO_2$ P25 | Isobutyltrimethoxysilane (4) | 250 | 120 | 21 |
| T4 | AEROXIDE $TiO_2$ P90 | Isobutyltrimethoxysilane (4) | 250 | 120 | 14 |
| T5 | AEROXIDE $TiO_2$ P25 | n-Octyltrimethoxysilane (8) | 250 | 120 | 21 |
| T6 | AEROXIDE $TiO_2$ P25 | n-Hexadecyltrimethoxysilane (16) | 250 | 120 | 21 |

<Preparation of Resin Particles>

[Preparation of Resin Particles P1]

A glass vessel equipped with a stirrer, a condenser tube, a thermometer, and a nitrogen inlet tube was set in a water bath at a temperature of 80° C. Subsequently, 100 parts by mass of ion-exchanged water, and 2.5 parts by mass of a surfactant (sodium dodecylbenzenesulfonate) were put into the vessel. Subsequently, under stirring of the vessel contents, 0.2 parts by mass of ammonium persulfate, and 150 parts by mass of a monomer mixture (specifically, a mixture of divinylbenzene, styrene and methyl methacrylate in a molar ratio of 1:1:1) were added into the vessel in a dropwise manner at a constant speed over 1 hour under a nitrogen atmosphere at a temperature of 80° C. Then, under stirring of the vessel contents, the temperature of the vessel contents was increased to 100° C. in a nitrogen atmosphere to react the vessel contents for 1 hour in a nitrogen atmosphere at a temperature of 100° C. As a result, an emulsion containing anionic resin fine particles was obtained. Subsequently, the thus obtained emulsion was cooled, and dried for 18 hours at a temperature of 80° C. to obtain a powder of resin particles P1 having a number average primary particle diameter of 80 nm. A resin base of the resin particles P1 was composed of a resin having a structure crosslinked with divinylbenzene used as a crosslinking agent. In other words, the resin particles P1 were crosslinked resin particles. Besides, the resin particles P1 each included a crosslinked resin base composed of a polymer of divinylbenzene, styrene and methyl methacrylate, and a surfactant (anionic surfactant) adhering to the surface of the crosslinked resin base.

[Preparation of Resin Particles P2 to P7]

Resin particles P2 to P6 were respectively obtained in the same manner as in the preparation of the resin particles P1 except that the type and the amount (addition amount with respect to 100 parts by mass of ion-exchanged water) of the surfactant used were changed as shown in Table 3. Besides, resin particles P7 were obtained in the same manner as in the preparation of the resin particles P1 except that 150 parts by mass of a monomer mixture of styrene and methyl methacrylate in a molar ratio of 1:1 was used instead of 150 parts by mass of the monomer mixture (the mixture of divinylbenzene, styrene and methyl methacrylate in a molar ratio of 1:1:1) used in preparing the resin particles P1. Resin bases of the resin particles P2 to P6 polymerized using the monomer mixtures containing divinylbenzene were all composed of a resin having a structure crosslinked with divinylbenzene used as a crosslinking agent. In other words, the resin particles P2 to P6 were all crosslinked resin particles. Besides, the resin particles P2 to P6 each included a crosslinked resin base composed of a polymer of divinylbenzene, styrene and methyl methacrylate, and a surfactant (anionic surfactant or cationic surfactant) adhering to the surface of the crosslinked resin base. With respect to the number average primary particle diameter of the resin particles shown in Table 3, the same measurement result was obtained also when the measurement was performed on a powder of resin particles separated from toner particles after producing a toner by the method described below.

TABLE 3

| Resin Particles | Surfactant | Amount of Surfactant [parts by mass] | Crosslinked or Not | Number Average Primary Particle Diameter [nm] |
|---|---|---|---|---|
| P1 | Sodium Dodecylbenzenesulfonate (anionic surfactant) | 2.5 | Crosslinked | 80 |
| P2 | Sodium Dodecylbenzenesulfonate (anionic surfactant) | 2.6 | Crosslinked | 60 |
| P3 | Sodium Dodecylbenzenesulfonate (anionic surfactant) | 2.0 | Crosslinked | 140 |
| P4 | Stearyltrimethylammonium Chloride (cationic surfactant) | 2.5 | Crosslinked | 80 |
| P5 | Sodium Dodecylbenzenesulfonate (anionic surfactant) | 3.0 | Crosslinked | 30 |
| P6 | Sodium Dodecylbenzenesulfonate (anionic surfactant) | 1.5 | Crosslinked | 250 |
| P7 | Sodium Dodecylbenzenesulfonate (anionic surfactant) | 2.5 | Not Crosslinked | 80 |

<Production of Toner TA-1>

[Preparation of Toner Mother Particles]

An FM mixer ("FM-20B" manufactured by Nippon Coke & Engineering Co., Ltd.) was used to mix, at a rotational speed of 2400 rpm, 100 parts by mass of a non-crystalline polyester resin (acid value: 5.6 mgKOH/g, Tm: 120° C., Tg: 56° C., number average molecular weight (Mn): 1500, mass average molecular weight (Mw): 45000) used as a binder resin, 4 parts by mass of a colorant (C.I. Pigment Blue 15:3, component: copper phthalocyanine pigment), 1 part by mass of a charge control agent ("BONTRON (registered Japanese trademark) P-51" manufactured by Orient Chemical Industries, Co., Ltd., component: quaternary ammonium salt), and 5 parts by mass of a releasing agent ("CARNAUBA WAX NO. 1" manufactured by S. Kato & Co., component: carnauba wax).

Subsequently, the thus obtained mixture was melt-kneaded using a twin-screw extruder ("PCM-30" manufactured by Ikegai Corp.) at a material supply speed of 5 kg/hr., a shaft rotational speed of 160 rpm, and a set temperature (cylinder temperature) of 100° C. Thereafter, the thus obtained melt-kneaded product was cooled. The cooled melt kneaded product was pulverized using a mechanical pulverizer ("TURBO MILL T250" manufactured by FREUND-TURBO CORPORATION). Subsequently, the thus obtained pulverized product was classified using a classifier ("ELBOW JET TYPE EJ-LABO" manufactured by Nittetsu Mining Co., Ltd.). As a result, toner mother particles having a volume median diameter ($D_{50}$) of 6.8 μm were obtained.

[External Additive Addition]

An FM mixer (manufactured by Nippon Coke & Engineering Co., Ltd.) having a capacity of 10 L was used for mixing 100 parts by mass of the toner mother particles (the toner mother particles obtained as described above), 1.5 parts by mass of the silica particles S1, and 0.5 parts by mass of the titania particles T1 for 5 minutes, and then 0.8 parts by mass of the resin particles P1 were further added into the FM mixer, followed by mixing for another 5 minutes. Thus, the whole amount of the external additive (the silica particles S1, the titania particles T1, and the resin particles P1) was caused to adhere to the surfaces of the toner mother particles. The thus obtained powder (a powder of the toner mother particles having the external additive adhering thereto) was sifted using a 200-mesh sieve (having a pore size of 75 μm). As a result, a positively chargeable toner TA-1 was obtained.

<Production of Toners TA-2 to TA-5, TB-1 to TB-4, TB-6 and TB-7>

Positively chargeable toners TA-2 to TA-5, TB-1 to TB-4, TB-6 and TB-7 were respectively produced in the same manner as in the production of the toner TA-1 except that external additive particles (silica particles, titania particles, and resin particles) of types shown in Table 4 below were used in the external additive addition. In Table 4, the term "S particles" refers to silica particles, the term "T particles" refers to titania particles, and the term "P particles" refers to resin particles. It is noted that the amounts of the external additive particles used were the same as those employed in the production of the toner TA-1, and specifically, the amount of the silica particles was 1.5 parts by mass, that of the titania particles was 0.5 parts by mass, and that of the resin particles was 0.8 parts by mass.

<Production of Toners TA-6 and TA-7>

Positively chargeable toners TA-6 and TA-7 were produced in the same manner as in the production of the toner TA-1 except for the following: In the production of the toners TA-6 and TA-7, 90 parts by mass of a non-crystalline polyester resin (acid value: 5.6 mgKOH/g, Tm: 120° C., Tg: 56° C., number average molecular weight (Mn): 1500, mass average molecular weight (Mw): 45000), and 10 parts by mass of the composite resin R1 were used as the binder resin in the preparation of the toner mother particles. In the production of the toners TA-6 and TA-7, external additive particles (silica particles, titania particles, and resin particles) of types shown in Table 4 below were used in the external additive addition. It is noted that the amounts of the external additive particles used were the same as those employed in the production of the toner TA-1, and specifically, the amount of the silica particles was 1.5 parts by mass, that of the titania particles was 0.5 parts by mass, and that of the resin particles was 0.8 parts by mass.

<Production of Toner TB-5>

A positively chargeable toner TB-5 was produced in the same manner as in the production of the toner TA-1 except for the following: In the production of the toner TB-5, resin particles were not used but 1.5 parts by mass of the silica particles S6 and 0.5 parts by mass of the titania particles T5 alone were used as the external additive particles in the external additive addition.

<Production of Toner TB-8>

A positively chargeable toner TB-8 was produced in the same manner as in the production of the toner TA-1 except for the following: In the production of the toner TB-8, titania particles were not used but 2.0 parts by mass of the silica particles S1 and 0.8 parts by mass of the resin particles P1 alone were used as the external additive particles in the external additive addition.

<Preparation of Two-component Developer>

A two-component developer was prepared by mixing 100 parts by mass of a developer carrier (carrier for "TASKalfa5551ci" manufactured by KYOCERA Document Solutions Inc.) and 8 parts by mass of a toner (toner to be evaluated: any one of the toners T1-1 to TA-7 and TB-1 to TB-8) using a ball mill for 30 minutes.

<Charge Stability>

A multifunction peripheral ("TASKalfa5551ci" manufactured by KYOCERA Document Solutions Inc.) was used as an evaluation apparatus. The two-component developer prepared as described above was loaded into a developing device for cyan color in the evaluation apparatus, and a toner for replenishment use (toner to be evaluated: any one of the toners TA-1 to TA-7 and TB-1 to TB-8) was loaded into a toner container for cyan color in the evaluation apparatus. Subsequently, a printing durability test was carried out by printing an image of a coverage of 5% successively on 100,000 sheets of paper (A4 size plain paper) using the evaluation apparatus in an environment of a temperature of 25° C. and a humidity of 50% RH.

In the printing durability test, when continuous printing on 500 sheets was completed, and when continuous printing on 100,000 sheets was completed, the developing device for cyan color was taken out of the evaluation apparatus, the two-component developer was taken out of the developing device for cyan color, and an amount of charge of the toner included in the two-component developer was measured using a Q/m meter by the following method.

[Method for Measuring Amount of Charge of Toner]

In an environment of a temperature of 25° C. and a humidity of 50% RH, 0.10 g of the two-component developer (toner and carrier) was put into a measurement cell of a Q/m meter ("MODEL 210HS-1" manufactured by TREK, Inc.), and merely the toner included in the two-component developer thus put was sucked through a sieve (wire netting) for 10 seconds. An amount of charge (unit: μC/g) of the toner was calculated in accordance with an expression, "Total amount of electricity (unit: μC) of the sucked toner/Mass (unit: g) of the sucked toner".

Herein, the amount of charge of the toner measured when the continuous printing on 500 sheets was completed is referred to as the "charge amount Q1", or simply as "Q1". Besides, the amount of charge of the toner measured when the continuous printing on 100,000 sheets was completed is referred to as the "charge amount Q2", or simply as "Q2".

Based on the thus obtained charge amounts Q1 and Q2, a charge amount difference ΔQ (unit: μC/g) was obtained in accordance with an expression, "Charge amount difference $\Delta Q=|Q1-Q2|$". The charge amount difference ΔQ was a difference (absolute value) between the charge amount Q1 and the charge amount Q2. Hereinafter, the charge amount difference ΔQ is also referred to simply as "ΔQ". When ΔQ was smaller than 4 μC/g, the toner was evaluated as "particularly excellent in charge stability", and when ΔQ was at least 4 μC/g and smaller than 8 μC/g, the toner was evaluated as "excellent in charge stability", and when ΔQ was at least 8 μC/g, the toner was evaluated as "poor in charge stability".

<Anti-Fogging Performance>

A reflection density of a blank portion of the 100,000th sheet printed in the above-described printing durability test was measured using a reflectance densitometer ("SPECTROEYE (registered Japanese trademark)" manufactured by X-Rite Inc.). Then, a fogging density (FD) was calculated in accordance with the following expression:

Fogging density=Reflection density of blank portion−Reflection density of unprinted paper When the fogging density (FD) was smaller than 0.015, the toner was evaluated as A (excellent in anti-fogging performance), and when the fogging density (FD) was at least 0.015, the toner was evaluated as B (poor in anti-fogging performance).

<Cleaning Performance>

A multifunction peripheral ("TASKalfa5551ci" manufactured by KYOCERA Document Solutions Inc.) was used as an evaluation apparatus. The two-component developer prepared as described above was loaded into a developing device for cyan color in the evaluation apparatus, and a toner for replenishment use (toner to be evaluated: any one of the toners TA-1 to TA-7 and TB-1 to TB-8) was loaded into a toner container for cyan color in the evaluation apparatus. Subsequently, an image X was successively printed on 100,000 sheets of paper (A4 size plain paper) in an environment of a temperature of 25° C. and a humidity of 50% RH. The image X was an image of stripes (number of lines: 5, line width: 20 mm, space: 10 mm) parallel to a conveying direction of the paper for printing.

Thereafter, an entirely solid image was printed on one sheet of paper (A4 size plain paper) in an environment of a temperature of 25° C. and a humidity of 50% RH. Subsequently, a reflection density of a portion corresponding to an image portion (lines) of the image X (hereinafter referred to as the image corresponding portion) in the printed entirely solid image was measured using a reflectance densitometer ("SPECTROEYE (registered Japanese trademark)" manufactured by X-Rite Inc.). For the measurement of the reflection density, 10 measurement points were randomly selected first in the image corresponding portion, and the reflection densities of the selected measurement points were respectively measured. Then, the highest reflection density among the thus obtained measured values (reflection densities) was determined as the "reflection density of the image corresponding portion".

Subsequently, a reflection density of a portion corresponding to a non-image portion (namely, spaces between lines) of the image X (hereinafter referred to as the non-image corresponding portion) in the printed entirely solid image was measured. For the measurement of the reflection density, 10 measurement points were randomly selected first in the non-image corresponding portion, and the reflection densities of the selected measurement points were respectively measured. Then, the highest reflection density among the thus obtained measured values (reflection densities) was determined as the "reflection density of the non-image corresponding portion".

Based on the reflection density of the image corresponding portion and the reflection density of the non-image corresponding portion thus obtained, a reflection density difference was calculated in accordance with an expression, "Reflection density difference=|Reflection density of image corresponding portion−Reflection density of non-image corresponding portion|". The reflection density difference was a difference (absolute value) between the reflection density of the image corresponding portion and the reflection density of the non-image corresponding portion. When the cleaning performance is lowered, the reflection density of the image corresponding portion tends to be higher than the reflection density of the non-image corresponding portion.

When the reflection density difference thus obtained was smaller than 0.04, the toner was evaluated as A (particularly excellent in cleaning performance). When the reflection density difference was at least 0.04 and smaller than 0.08, the toner was evaluated as B (excellent in cleaning performance). When the reflection density difference was at least 0.08, the toner was evaluated as C (poor in cleaning performance).

<Non-Filming Property>

A multifunction peripheral ("TASKalfa5551ci" manufactured by KYOCERA Document Solutions Inc.) was used as an evaluation apparatus. The two-component developer prepared as described above was loaded into a developing device for cyan color in the evaluation apparatus, and a toner for replenishment use (toner to be evaluated: any one of the toners TA-1 to TA-7 and TB-1 to TB-8) was loaded into a toner container for cyan color in the evaluation apparatus. Subsequently, an image of a coverage of 4% was successively printed on 10,000 sheets of paper (A4 size plain paper) in an environment of a temperature of 25° C. and a humidity of 50% RH. Thereafter, it was visually checked whether or not a substance was adhering onto the surface of a photosensitive drum of the evaluation apparatus. When no substance was adhering, the toner was evaluated as A (excellent in non-filming property), and when any substance was adhering, the toner was evaluated as B (poor in non-filming property).

The external additive particles used, the evaluation results for the charge stability, the evaluation results for the anti-fogging performance, the evaluation results for the cleaning performance, and the evaluation results for the non-filming property of the toners TA-1 to TA-7 and TB-1 to TB-8 are shown in Table 4.

TABLE 4

| | | External Additive Particles | | | Charge Stability | | | Anti-fogging | Cleaning | Non-filming |
|---|---|---|---|---|---|---|---|---|---|---|
| | Toner | S Particles | T Particles | P Particles | Q1 [μC/g] | Q2 [μC/g] | ΔQ [μC/g] | Performance | Performance | Property |
| Example 1 | TA-1 | S1 | T1 | P1 | 35 | 30 | 5 | A | B | A |
| Example 2 | TA-2 | S2 | T2 | P2 | 33 | 28 | 5 | A | B | A |
| Example 3 | TA-3 | S3 | T3 | P3 | 27 | 21 | 6 | A | A | A |
| Example 4 | TA-4 | S3 | T4 | P3 | 27 | 23 | 4 | A | A | A |
| Example 5 | TA-5 | S4 | T1 | P4 | 34 | 31 | 3 | A | A | A |

TABLE 4-continued

| | | External Additive Particles | | | Charge Stability | | | Anti-fogging | Cleaning | Non-filming |
|---|---|---|---|---|---|---|---|---|---|---|
| | Toner | S Particles | T Particles | P Particles | Q1 [μC/g] | Q2 [μC/g] | ΔQ [μC/g] | Performance | Performance | Property |
| Example 6 | TA-6 | S5 | T2 | P3 | 33 | 26 | 7 | A | B | A |
| Example 7 | TA-7 | S6 | T5 | P4 | 31 | 28 | 3 | A | B | A |
| Comparative Example 1 | TB-1 | S7 | T2 | P2 | 35 | 30 | 5 | A | C | A |
| Comparative Example 2 | TB-2 | S8 | T6 | P1 | 32 | 27 | 5 | B | B | A |
| Comparative Example 3 | TB-3 | S2 | T2 | P5 | 33 | 25 | 8 | A | B | A |
| Comparative Example 4 | TB-4 | S9 | T2 | P1 | 14 | 10 | 4 | B | B | A |
| Comparative Example 5 | TB-5 | S6 | T5 | None | 36 | 23 | 13 | A | B | B |
| Comparative Example 6 | TB-6 | S2 | T2 | P6 | 32 | 22 | 10 | B | B | A |
| Comparative Example 7 | TB-7 | S1 | T1 | P7 | 34 | 30 | 4 | A | B | B |
| Comparative Example 8 | TB-8 | S1 | None | P1 | 40 | 33 | 7 | B | B | A |

As shown in Tables 1 to 4, in each of the toners TA-1 to TA-7, the external additive included, as the external additive particles, silica particles having a number average primary particle diameter of at least 10 nm and no greater than 35 nm, titania particles having a number average primary particle diameter of at least 10 nm and no greater than 30 nm, and crosslinked resin particles having a number average primary particle diameter of at least 40 nm and no greater than 200 nm. In each of the toners TA-1 to TA-7, the silica particles included in the external additive each included a silica base and a first surface treatment layer present on a surface of the silica base. In each of the toners TA-1 to TA-7, the titania particles included in the external additive each included a titania base and a second surface treatment layer present on a surface of the titania base. In each of the toners TA-1 to TA-7, the first surface treatment layer of each silica particle included in the external additive contained an alkyl group having a carbon number of at least 8 and no greater than 16, and an amino group. In each of the toners TA-1 to TA-7, the second surface treatment layer of each titania particle included in the external additive contained an alkyl group having a carbon number of at least 3 and no greater than 8.

As shown in Table 4, the toners TA-5 and TA-7 each had a ΔQ smaller than 4 μC/g. Therefore, the toners TA-5 and TA-7 were particularly excellent in charge stability. The toners TA-1 to TA-4 and TA-6 each had a ΔQ of at least 4 μC/g and smaller than 8 μC/g. Therefore, the toners TA-1 to TA-4 and TA-6 were excellent in charge stability.

As shown in Table 4, the toners TA-1 to TA-7 were evaluated as A for the anti-fogging performance. Therefore, the toners TA-1 to TA-7 were excellent in anti-fogging performance.

As shown in Table 4, the toners TA-3 to TA-5 were evaluated as A for cleaning performance. Therefore, the toners TA-3 to TA-5 were particularly excellent in cleaning performance. The toners TA-1, TA-2, TA-6 and TA-7 were evaluated as B for cleaning performance. Therefore, the toners TA-1, TA-2, TA-6 and TA-7 were excellent in cleaning performance.

As shown in Table 4, the toners TA-1 to TA-7 were evaluated as A for the non-filming property. Therefore, the toners TA-1 to TA-7 were excellent in non-filming property.

As shown in Tables 1 and 4, in the toner TB-1, silica particles included in the external additive had a number average primary particle diameter larger than 35 nm. In the toner TB-4, a surface treatment layer of each silica particle included in the external additive did not have an amino group.

In the toner TB-2, a surface treatment layer of each titania particle included in the external additive had an alkyl group. In the toner TB-2, however, the alkyl group contained in the surface treatment layer of the titania particle had a carbon number larger than 8. In the toner TB-8, the external additive did not include titania particles.

As shown in Tables 3 and 4, in the toner TB-3, the number average primary particle diameter of the crosslinked resin particles included in the external additive was smaller than 40 nm. In the toner TB-5, the external additive did not include crosslinked resin particles. In the toner TB-6, the number average primary particle diameter of the crosslinked resin particles included in the external additive was larger than 200 nm. In the toner TB-7, the external additive contained resin particles. The resin particles included in the toner TB-7 were, however, not crosslinked resin particles.

As shown in Table 4, the toners TB-3, TB-5 and TB-6 each had a ΔQ of at least 8 μC/g. Therefore, the toners TB-3, TB-5 and TB-6 were poor in charge stability. The toners TB-2, TB-4, TB-6 and TB-8 were evaluated as B for anti-fogging performance. Therefore, the toners TB-2, TB-4, TB-6 and TB-8 were poor in anti-fogging performance. The toner TB-1 was evaluated as C for cleaning performance. Therefore, the toner TB-1 was poor in cleaning performance. The toners TB-5 and TB-7 were evaluated as B for non-filming property. Therefore, the toners TB-5 and TB-7 were poor in non-filming property.

Based on these results, it was revealed that the toner according to the present disclosure has improved cleaning performance, charge stability, anti-fogging performance and non-filming property.

What is claimed is:

1. A positively chargeable toner comprising toner particles, wherein the toner particles each include a toner mother particle containing a binder resin, and an external additive adhering to a surface of the toner mother particle, the external additive includes, as external additive particles, silica particles having a number average primary particle diameter of at least 10 nm and no greater than 35 nm, titania particles having a number average primary particle diameter of at least 10 nm and no greater than 30 nm, and crosslinked resin particles having a number average primary particle diameter of at least 40 nm and no greater than 200 nm, the silica particles each include a silica base, and a first surface treatment layer present on a surface of the silica base, the first surface treatment layer has an alkyl group having a carbon number of 8, and an amino group, the titania particles each include a titania base, and a second surface treatment layer present on a surface of the titania base, the second surface treatment layer has an alkyl group having a carbon number of 3, the crosslinked resin particles each include a crosslinked resin base, and a cationic surfactant adhering to a surface of the crosslinked resin base, and all of the crosslinked resin particles protrude beyond the silica particles and the titania particles on surfaces of the toner particles.

2. The positively chargeable toner according to claim 1, wherein the binder resin contains a crystalline resin.

3. The positively chargeable toner according to claim 1, wherein an amount of the silica particles is at least 1.0 part by mass and no greater than 2.0 parts by mass with respect to 100 parts by mass of the toner mother particles, an amount of the titania particles is at least 0.1 parts by mass and no greater than 1.0 part by mass with respect to 100 parts by mass of the toner mother particles, and an amount of the crosslinked resin particles is at least 0.5 parts by mass and no greater than 1.0 part by mass with respect to 100 parts by mass of the toner mother particles.

4. The positively chargeable toner according to claim 1, wherein the crosslinked resin particles include a repeating unit derived from divinylbenzene, a repeating unit derived from styrene, and a repeating unit derived from methyl methacrylate, and a molar ratio of the repeating unit derived from divinylbenzene, the repeating unit derived from styrene, and the repeating unit derived from methyl methacrylate is 1:1:1.

5. The positively chargeable toner according to claim 1, wherein the silica base is subjected to surface treatment with n-octyltrimethoxysilane and 3-aminopropyltriethoxysilane, and the titania base is subjected to surface treatment with n-propyltrimethoxysilane.

* * * * *